US010213657B1

(12) United States Patent
Klevana et al.

(10) Patent No.: US 10,213,657 B1
(45) Date of Patent: Feb. 26, 2019

(54) GOLF BALL RETRIEVER

(71) Applicant: Dynamic Brands, LLC, Richmond, VA (US)

(72) Inventors: Leighton Klevana, Richmond, VA (US); Patrick Gallagher, Midlothian, VA (US)

(73) Assignee: Dynamic Brands, LLC, Richmond, VA (US)

( * ) Notice: Subject to any disclaimer, the term of this patent is extended or adjusted under 35 U.S.C. 154(b) by 0 days.

(21) Appl. No.: 15/795,472

(22) Filed: Oct. 27, 2017

(51) Int. Cl.
*A63B 47/02* (2006.01)
*A63B 57/00* (2015.01)

(52) U.S. Cl.
CPC ..... *A63B 47/02* (2013.01); *A63B 57/00* (2013.01); *A63B 2209/00* (2013.01); *A63B 2210/58* (2013.01); *A63B 2225/09* (2013.01)

(58) Field of Classification Search
CPC ..... B63C 11/50; A01D 46/24; A63B 47/02; A63B 57/00; A63B 2225/09; A63B 2210/58; A63B 2209/00
USPC ..... 294/210; D21/721
See application file for complete search history.

(56) References Cited

U.S. PATENT DOCUMENTS

| | | | | |
|---|---|---|---|---|
| 1,658,145 | A | 2/1928 | Uyei | |
| 3,442,544 | A | 5/1969 | Faber | |
| 3,669,427 | A | 6/1972 | Curtis | |
| 3,901,545 | A * | 8/1975 | Shott | A63B 47/02 294/19.2 |
| 4,728,134 | A | 3/1988 | Allen | |
| 4,844,526 | A | 7/1989 | Young | |
| 5,246,260 | A | 9/1993 | Racicot | |
| 5,303,967 | A | 4/1994 | Dubow | |
| 5,423,584 | A | 6/1995 | Pasternak | |
| 5,651,571 | A | 7/1997 | Diveto | |
| 5,662,366 | A | 9/1997 | Fraske | |
| 5,829,806 | A | 11/1998 | Sykes | |
| 5,997,062 | A | 12/1999 | Schwartz | |
| 6,059,334 | A | 5/2000 | LaCourse et al. | |
| 6,257,635 | B1 | 7/2001 | Torelli | |
| 6,695,370 | B2 | 2/2004 | Johnson | |

(Continued)

FOREIGN PATENT DOCUMENTS

| | | | |
|---|---|---|---|
| GB | 2128484 | A | 5/1984 |
| GB | 2282973 | A | 4/1995 |
| GB | 2305865 | A | 4/1997 |

*Primary Examiner* — Stephen A Vu
(74) *Attorney, Agent, or Firm* — Bernard G. Pike; Pike IP Law, PLLC

(57) ABSTRACT

The golf ball retriever is a tool for assisting in the recovery of golf balls from water hazards, weeds, muddy areas, or other difficult to reach areas. A typical golf ball retriever comprises a handle and a ball grabbing head. The handle extends the reach of the golfer to reach a golf ball. The ball grabbing head allows the golfer to grab the ball and retain it until the golfer to bring the ball within reach and remove the ball grabbing head for further play. A ball grabbing head may have an inner surface and a plurality of inwardly protruding fingers on the inner surface. The most inward facing portion of at least a portion of the plurality of inwardly or radially protruding fingers may be coated with a rubber liner to increase the golfer's ability to recover the golf ball efficiently. The rubber liner may be a thermoplastic elastomer.

21 Claims, 3 Drawing Sheets

(56) References Cited

U.S. PATENT DOCUMENTS

| | | | | |
|---|---|---|---|---|
| 6,719,340 | B2 * | 4/2004 | Imig | A63B 47/02 294/19.2 |
| 7,311,345 | B2 * | 12/2007 | Kerr | A63B 47/02 294/19.2 |
| 7,713,136 | B1 * | 5/2010 | Colucci | A63B 47/02 294/19.2 |
| 8,201,864 | B2 * | 6/2012 | Wright | A63B 47/02 294/19.2 |
| 2003/0195054 | A1 | 10/2003 | Rioux | |
| 2009/0108601 | A1 * | 4/2009 | Lee | A63B 47/02 294/19.2 |
| 2015/0202501 | A1 * | 7/2015 | Light | A63B 47/02 294/19.2 |
| 2015/0273283 | A1 * | 10/2015 | Davis | A63B 47/02 294/19.2 |

* cited by examiner

GOLF BALL RETRIEVER

FIELD OF THE INVENTION

Golf ball retrievers are used to retrieve golf balls beyond the reach of a person. A golf ball retriever may be used to recover a golf ball that is in water such as a water hazard, in a muddy area of the golf course, or into the woods, bushes or weeds off the fairway of the golf course.

BACKGROUND OF THE INVENTION

Golf is a popular sport that takes a significant amount of playing time to play proficiently. Even the best golfers will sometimes hit an errant shot that results in the ball ending up in a water hazard, other hazard, or out of bounds. The golf ball may be found in a location that is out of the reach of the golfer without an appropriate tool to recover it. Losing golf balls can significantly increase the costs of golfing. Even without losing balls, golf is one of the most expensive sports to play and the golf balls are relatively expensive. The highest quality golf balls can cost four dollars each. Therefore, a golfer is motivated to retrieve all their errant golf balls, especially ones that can be seen but are out of easy reach of the golfer.

Golf ball retrievers for recovering golf balls from hard to reach locations are popular with golfers and reduce their golfing expenses. A typical golf ball retriever has a telescoping shaft connected to a ball gripping head. Some ball gripping heads may have a cup shaped head, ball capturing mechanisms, claws that grab the ball or other types of heads. These golf ball retrievers have various degrees of effectiveness of grabbing and retaining a ball to aid in recovery.

There is a need for a golf ball retriever that has an increased coefficient of friction to increase the effectiveness of the golf ball retriever for recovering a golf ball.

SUMMARY OF THE INVENTION

The golf ball retriever is a tool for assisting in the recovery of golf balls from water hazards, weeds, muddy areas, or other difficult to reach areas. Embodiments of a golf ball retriever comprise a handle and a ball grabbing head.

The handle extends the reach of the golfer to reach a golf ball that would otherwise be out of reach. The ball grabbing head allows the golfer to grab the ball and retain it until the golfer to bring the ball within reach and remove the ball grabbing head for further play. The ball grabbing head is designed to ease the recovery of the golf ball. In some embodiments, the ball grabbing head has an inner surface and a plurality of inwardly protruding fingers on the inner surface. The most inward facing portion of at least a portion of the plurality of inwardly or radially protruding fingers may be coated with a rubber liner to increase the golfer's ability to recover the golf ball efficiently. The rubber liner may be a thermoplastic elastomer, for example.

The ball grabbing head may be a hard plastic, wood, metal or other stiff supportive material. For example, the ball grabbing head may be made from a poly(acrylonitrile-butadiene-styrene).

The ball gripping head may be in the shape such as, but not limited to, a ring with inwardly facing fingers, for example. The body of the ball gripping head may be any desired shape, however, the inner most tip of the inwardly facing fingers will terminate to define points along a circumference of a circle that has approximately the same or slightly less diameter than a golf ball. The opening may be defined by the rubber liner coated on the fingers to retain a golf ball pressed into the opening. The golf ball retriever may comprise a plurality of protruding fingers that may be evenly or unevenly spaced around the inward surface.

As discussed, the rubber liner on the inner surface and/or the inwardly or radially extending fingers define a golf ball grabbing and retaining opening having a smaller diameter than the diameter of the golf ball. The amount of grip exerted on the golf ball depends on the number and size of the fingers and the coefficient of friction of the rubber liner. In one embodiment, the fingers may comprise less 60 percent of the inner surface. In another embodiment, collectively, the fingers may comprise between 25% and 50% of circumference the inner surface.

The width of the fingers should be sufficient to provide enough gripping to grab and retain the golf ball as the ball is recovered and returned to the user. In another embodiment, the fingers have a width at the connection to the inner surface of less than 10% of the circumference of the inner surface. In another embodiment, the fingers have a width at the connection to the inner surface of less than 5% of the circumference of the inner surface.

In additional embodiments, the ball grabbing head may have an inner surface without a plurality of inwardly protruding fingers on the inner surface. At least a portion of the inner surface and/or the fingers may be coated with a rubber liner.

Other aspects and features of embodiments of the golf ball retrievers will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DESCRIPTION

A golf ball retriever is a tool for assisting in the recovery of golf balls from water hazards, weeds, muddy areas, bushes, or other difficult or out of reach areas on or along a golf course.

Embodiments of the golf ball retriever comprise a handle and a ball grabbing head. The handle may be of any desired length. Further, embodiments of the handle may be a fixed length handle or extendible handle that may be converted a compact state to an extended state and multiple lengths between the compact state and the extended state. For embodiments of the extendible handle, the golf ball retriever may be easily stored in a golf bag when it is in the compact state. After removal from the golf bag, the handle may be extended to assist in recovering a golf ball then conveniently returned to the compact state and again stored in the golf bag for later use. An extendible handle may be a telescoping handle, a plurality of articulating segments, or other extendible designs.

Figure 1:
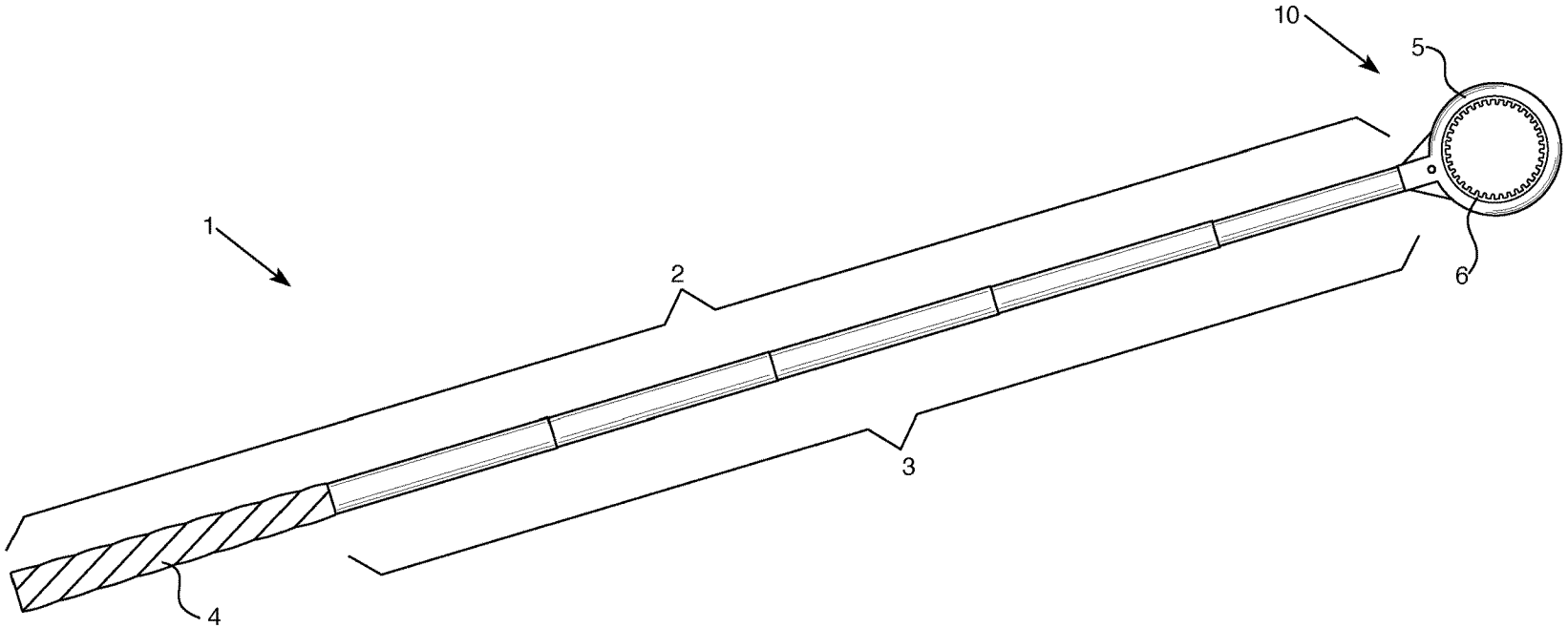
FIG. 1 is a plan view of an embodiment of a golf ball retriever according to the present invention.

An embodiment of a golf ball retriever 1 is shown in FIG. 1. The golf ball retriever 1 comprises a handle 2 and a ball grabbing head 10. The handle 2 may comprise a grip 4 and a shaft 3. The shaft 3 extends the reach of the user and the ball grabbing head 10 allows the golfer to grab the ball and retain it until the user extracts the ball from the ball grabbing head 10. The handle 2 may be any operable length, a longer handle provides greater extension distance to reach golf balls that are further away but may be more difficult to maneuver over the ball and capture it in the ball gripping head 10. The embodiment of the ball grabbing head shown in FIG. 1 has a body 5 having an inner surface and a rubber liner 6 adhered to the inner surface.

The ball retriever comprises ball gripping head having a body defining a ball grabbing opening. The body of the ball gripping head may be any desired shape such as, but not limited to, round, cylindrical, cup shaped, oval, square, rectangular, triangular, or a combination of these shapes, for example. However, the inner most tip of the inwardly facing fingers should terminate to define points along a circumference of a circle that has approximately the same or slightly shorter diameter than the golf ball to be recovered. As such, the opening defined by the fingers and the rubber liner can retain a golf ball pressed into the opening. The golf ball retriever may comprise a plurality of protruding fingers that may be evenly or unevenly spaced around the inward surface.

The rubber liner defines an opening having a smaller diameter than the diameter of the golf ball. The amount of gripping of the golf ball depends on the number of fingers, the size of the fingers, the contact area of the fingers to the golf ball, and the coefficient of friction of the rubber liner. In one embodiment, the fingers may comprise less than 60 percent of the inner surface, for example. In another embodiment, the fingers may comprise between 25% and 50% of circumference the inner surface.

The collective width of the fingers should be sufficient to provide enough grip to grab and retain the golf ball as the ball is recovered and returned to the user. In another embodiment, the individual fingers have a width at the connection to the inner surface of less than 10% of the circumference of the inner surface. In another embodiment, the fingers have a width at the connection to the inner surface of less than 5% of the circumference of the inner surface and in another embodiment, the fingers have a width of less than 3% of the circumference of the inner surface or the ball grabbing circumference. The number, depth, width and length of the fingers will determine the ease of grabbing and retaining the ball. In the embodiment of the ball retriever head 10 shown in FIG. 2 and FIG. 2A, the ball retriever head 10 has thirty-six fingers. These fingers may be between 0.5 mm and 2.5 mm in length B. In the embodiment shown in FIG. 2, the fingers are 1.5 mm in length B and have 2.5 mm space A between the fingers. In the embodiment of the ball retriever head shown on FIG. 3, the ball retriever head 10 has eighteen fingers however, the fingers have a greater length B resulting in similar contact surface area between the ball retriever head and the golf ball to be recovered. The length B of the embodiment of FIG. 3 may be between 2.0 mm and 5.0 mm in length B, for example.

In additional embodiments (not shown), the ball grabbing head has an inner surface without a plurality of inwardly protruding fingers on the inner surface. At least a portion of the inner surface may be with a rubber liner defining an opening having a diameter or circumference sufficiently smaller than the diameter or circumference of a golf ball. In such an embodiment, the ball grabbing head may contact the golf ball with the full circumference of the inner surface of the ball grabbing head.

Figure 2:
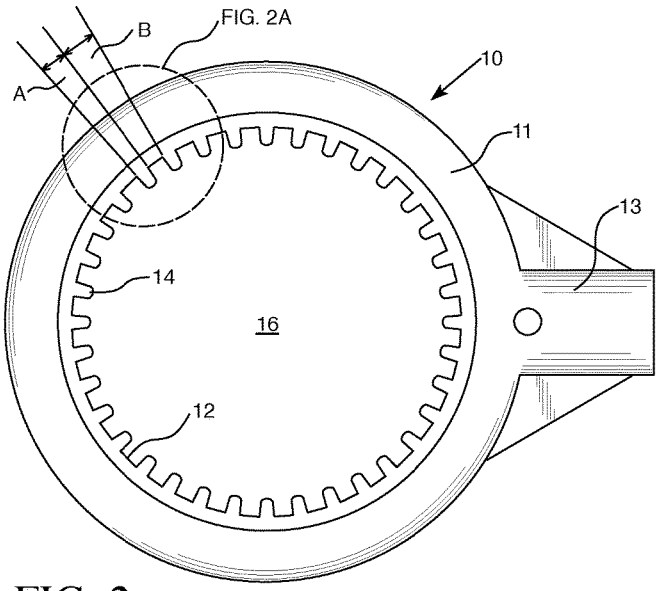
FIG. 2 is a plan view of an embodiment of a ball grabbing head, wherein the ball grabbing head has an inner surface and a plurality of inwardly protruding fingers on the inner surface with a rubber liner over the fingers of the ball grabbing device.
Figure 3:
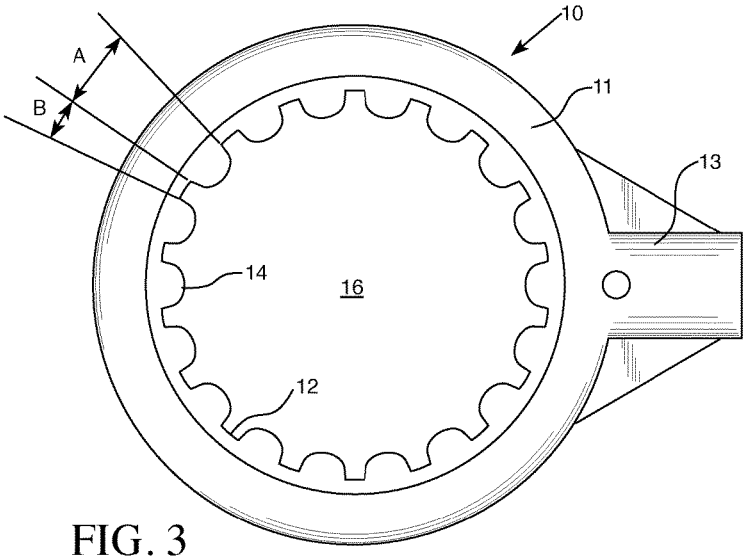
FIG. 3 is an exploded view of a second embodiment of the ball grabbing head of the present invention.
Figure 2A:
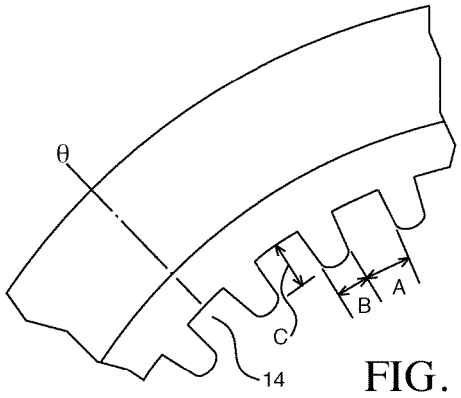
FIG. 2A is an exploded view of the circled portion of the embodiment of the ball grabbing head of FIG. 2.
Figure 2B:
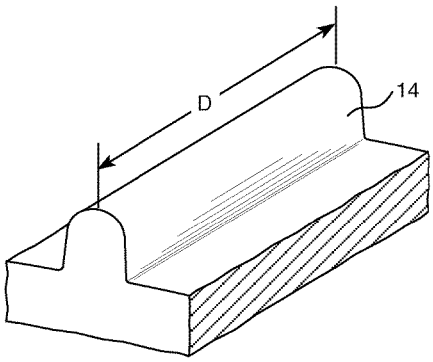
FIG. 2B depicts an embodiment of a finger of the embodiment of the ball grabbing head of FIG. 2.

An embodiment of a ball grabbing head 10 is shown in FIG. 2. The ball grabbing head 10 has a handle connection portion 13 to connect to the handle 2. The ball grabbing head 10 has body 11 having an inner surface 12 with a plurality of inwardly or radially protruding fingers 14. The inner surface may be in any shape but the inwardly or radially protruding fingers 14 are configured to grab and retain a golf ball. The fingers 14 define a circle with a diameter capable of receiving and retaining a golf ball. The United States Golf Association specifies that a golf ball (USGA Ball) must be spherical in shape and be no less than 1.68-inches (42.7 mm) in diameter. The British Ball may be smaller than the USGA Ball having a diameter of 1.62-inches (41.1 mm). In the embodiment of the ball grabbing head 10 of FIG. 2, the radius of the inner surface 12 is approximately 23.25 mm (approximately 46.5 mm in diameter and a circumference of approximately 146 mm) and the length C of the fingers including the rubber liner is approximately 2 mm in this embodiment. The inner diameter of the ball grabbing area 16 of the ball grabbing head 10 is approximately 42.5 mm. This is approximately 0.2 mm less than the diameter of a USGA regulation golf ball. In some embodiments, the inner diameter of the ball grabbing area of the ball grabbing head may be between 0.05 mm to 0.5 mm less than the diameter of the golf ball to be recovered.

Figure 4:
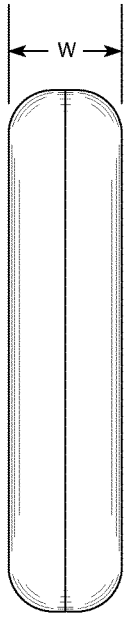
FIG. 4 is a side view of the embodiment of a ball grabbing head of FIG. 2.
Figure 2D:
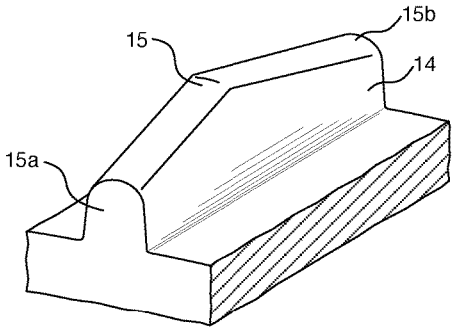
FIG. 2D depicts an embodiment of a finger having two sloping surfaces that form a peak on the grabbing surface of the tooth of a ball grabbing head.
Figure 2C:
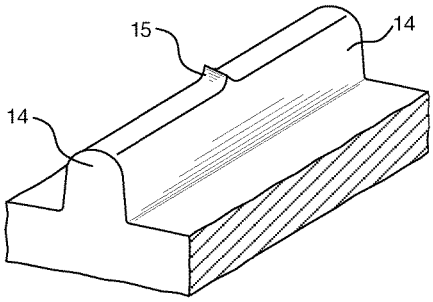
FIG. 2C depicts an embodiment of a finger having a protrusion on the grabbing surface of a ball grabbing head.

The fingers 14 may extend the width W of the body 11 or extend any length shorter or longer as shown in FIG. 4. At the center or near the center of the depth D of the finger, the finger 14 may have a ball grabbing protrusion 15 to reduce the chance of the golf ball slipping through the golf ball head 10. In FIG. 2C, the ball grabbing protrusion 15 is shown as a nub or protrusion extending from near the center of the finger 14. In FIG. 2D, the embodiment of the ball grabbing protrusion 15 is constructed by two sloping ridges 15*a* and 15*b* which reach a peak in the middle of the finger 14.

The most inward facing portion of at least a portion of the plurality of inwardly or radially protruding fingers may be coated with a rubber liner. In addition, the ball grabbing protrusion 15 may also be coated with the rubber liner.

The ball grabbing head and the fingers may be a hard plastic, metal, combination thereof, or other rigid support material. For example, the ball grabbing head may be made from a thermoplastic polymer such as, but not limited to, poly(acrylonitrile-butadiene-styrene), a polycarbonate, polybutadiene terephthalate, polyamides, polyacetals, and alloys or blends thereof. A portion of the ball grabbing head and the fingers may be coated with a thermoplastic elastomer to form The rubber liner may be a thermoplastic elastomer. A thermoplastic elastomer is a material having the ability to be stretched to moderate elongations and, upon the removal of stress, return to something close to its original shape, processable as a melt at elevated temperature, and an absence of significant creep. Thermoplastic elastomers include, but are not limited to, styrene based block copolymers, thermoplastic olefins, thermoplastic polyurethanes, thermoplastic polyesters, and thermoplastic polyamides, for example. The thermoplastic elastomer provides an increased coefficient of friction for grabbing the ball and provides a resilient protective layer over the more brittle body of the ball retriever head.

An embodiment of a method of producing a golf ball retriever comprises coating, overmolding, or otherwise adhering a rubber liner to a ball grabbing surface of ball retriever. In an overmolding method, the method may comprise molding a ball grabbing body from a thermoplastic resin and subsequently overmolding the ball grabbing body with a thermoplastic elastomer on a ball grabbing surface of the ball grabbing body. Overmolded thermoplastic elastomers have excellent adhesion to a wide variety of substrates including to engineering resins, such as PC, ABS, polyacetal and nylon.

There are two primary injection molding processes for the manufacture of overmolded products. These two processes are insert molding and multi-shot injection molding. The most widely used process is insert molding. For an insert molding process, a pre-molded ball grabbing body is placed into a second mold with an open volume where the thermoplastic elastomer is to be added. The thermoplastic elastomer is injected directly over the ball grabbing body within the mold to form the rubber liner. The advantage of insert molding is that conventional single shot injection molding machines can be used and the tooling costs associated with insert molding are lower than with multi-shot processing.

Multi-shot injection molding requires a special injection molding machine that is equipped with two or more barrels, allowing two (or more) materials to be injected into the same mold during a single molding cycle simultaneously forming the ball grabbing body and the rubber liner. Multi-shot molding may be chosen to reduce cycle times, achieve superior part quality and reduce labor costs. The ball grabbing body and the thermoplastic elastomer may comprise any of the features described herein.

The embodiments of the described methods and the ball retrievers are not limited to the embodiments, components, method steps, and materials disclosed herein as such components, process steps, and materials may vary. Moreover, the terminology employed herein is used to describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A golf ball retriever, comprising:

a handle;

a ball grabbing head, wherein the ball grabbing head comprises a body and the body has a width, an inner surface of the body and a plurality of inwardly protruding fingers on the inner surface, wherein the plurality of inwardly protruding fingers each has an innermost portion, the plurality of innermost portions defining a circular opening having a diameter dimensioned for receiving and retaining a golf ball between the innermost portion of each of the inwardly protruding fingers by frictional contact, wherein the inwardly protruding fingers extend inwardly toward a center of the circular opening and are within the width of the body; and a rubber liner on the plurality of inwardly protruding fingers of the ball grabbing head.

2. The golf ball retriever of claim 1, wherein the rubber liner comprises a thermoplastic rubber.

3. The golf ball retriever of claim 2, wherein the body and the fingers are formed from poly (acrylonitrile butadiene styrene).

4. The golf ball retriever of claim 2, wherein the body and fingers are made from a metal.

5. The golf ball retriever of claim 1, wherein the golf ball retriever comprises at least twelve inwardly protruding fingers.

6. The golf ball retriever of claim 5, wherein the inwardly protruding fingers are evenly spaced around the inner surface and define an opening smaller than a diameter of the golf ball.

7. The golf ball retriever of claim 1, wherein the golf ball retriever comprises at least eighteen inwardly protruding fingers.

8. The golf ball retriever of claim 1, wherein the golf ball retriever comprises at least thirty-six inwardly protruding fingers.

9. The golf ball retriever of claim 1, wherein the rubber liner has a greater coefficient of friction than the ball grabbing head.

10. The golf ball retriever of claim 1, wherein the handle comprises a shaft.

11. The golf ball retriever of claim 10, wherein the shaft extends radially from the center of the circle.

12. The golf ball retriever of claim 1, wherein both the handle and the fingers extends radially from the circle defined by the fingers.

13. The golf ball retriever of claim 12, wherein the protrusion is constructed by two sloping ridges from the edges of the fingers which reach a peak in the middle of the finger.

14. A golf ball retriever for retrieving a golf ball, comprising:

a handle;

a ball grabbing head, wherein the ball grabbing head comprises a circular inner surface, at least three inwardly protruding fingers on the circular inner surface, wherein the inwardly protruding fingers each has an innermost portion, wherein the plurality of innermost portions further define points along a circumference of a circular opening and the handle extends radially from the circular opening, wherein a diameter of the circular opening is less than a diameter of a golf ball and dimensioned to retain a golf ball between the inwardly protruding fingers by frictionally contacting with at least one surface of the golf ball with the innermost portions; and a rubber liner on the fingers of the ball grabbing head.

15. A golf ball retriever for retrieving a golf ball of claim 14, wherein a width of at least one of the fingers is less than 10% of the inner surface.

16. The golf ball retriever of claim 15, wherein the rubber liner covers the inner surface.

17. The golf ball retriever of claim 15, wherein the width of at least one of the fingers is less than 5% of the inner surface.

18. A golf ball retriever, comprising:

a handle;

a ball grabbing head, wherein the ball grabbing head having a body, an inner surface of the body and a plurality of inwardly protruding fingers extending radially from the inner surface of the body, wherein the inner surface of the body and the inwardly protruding fingers define a golf ball grabbing and retaining opening and each of the plurality of the inwardly protruding fingers comprise an innermost tip; and a rubber liner on the plurality of the inwardly protruding fingers and the innermost tips of the ball grabbing head, wherein the innermost tips of the inwardly protruding fingers with the rubber liner terminating to define points along a circumference of a circular opening configured for retaining the golf ball via frictional contact with at least one surface of the golf ball, wherein the circular opening has a diameter that is between 42 mm and 42.45 mm.

19. The golf ball retriever of claim 18, wherein the fingers are made of a rigid support material.

20. The golf ball retriever of claim 18, wherein the fingers comprise a ball grabbing protrusion and a depth; wherein the protrusion is near the center of the depth of the finger on the face of the finger opposite of the inner surface.

21. The golf ball retriever of claim 18, wherein the protrusion is near center of the depth of the innermost tip of the inwardly facing fingers.

* * * * *